US007922036B2

(12) United States Patent
Bendor et al.

(10) Patent No.: US 7,922,036 B2
(45) Date of Patent: Apr. 12, 2011

(54) CONTAINER FOR DISPENSING WIPES

(75) Inventors: Yarron Bendor, Scottsdale, AZ (US); Marcia Cole-Yocom, Scoottsdale, AZ (US); Donna Barker, Mesa, AZ (US); Stefano Bartolucci, London (GB); Johannes Lambertus Maria Mensink, Tervuren (BE)

(73) Assignee: The Procter & Gamble Company, Cincinnati, OH (US)

( * ) Notice: Subject to any disclaimer, the term of this patent is extended or adjusted under 35 U.S.C. 154(b) by 559 days.

(21) Appl. No.: 11/712,660

(22) Filed: Mar. 1, 2007

(65) Prior Publication Data

US 2007/0215631 A1 Sep. 20, 2007

Related U.S. Application Data

(60) Provisional application No. 60/782,994, filed on Mar. 16, 2006.

(51) Int. Cl.
*B65H 1/00* (2006.01)
*B65D 73/00* (2006.01)

(52) U.S. Cl. ..... 221/63; 221/47; 221/33; 221/45; 221/46; 221/197; 221/287; 221/48; 221/61; 206/494; 206/440; 206/497; 206/233; 229/232; 229/191; 229/229; 229/237

(58) Field of Classification Search ..... 221/63, 221/47, 33, 45, 46, 61, 283, 197, 287, 48; 229/232, 191, 229, 237; 206/494, 440, 497, 206/233
See application file for complete search history.

(56) References Cited

U.S. PATENT DOCUMENTS

| | | | | |
|---|---|---|---|---|
| 3,002,668 | A | 10/1961 | Castelli | |
| 3,986,479 | A | 10/1976 | Bonk | |
| 4,289,262 | A | 9/1981 | Finkelstein | |
| 4,526,291 | A * | 7/1985 | Margulies | 221/63 |
| 4,534,491 | A | 8/1985 | Norton et al. | |
| 4,535,912 | A | 8/1985 | Bonk | |
| 4,623,074 | A * | 11/1986 | Dearwester | 221/48 |
| 5,108,029 | A | 4/1992 | Abrams et al. | |
| 5,228,632 | A | 7/1993 | Addison et al. | |
| 5,386,910 | A * | 2/1995 | Liss | 206/554 |
| 5,462,197 | A * | 10/1995 | Pound | 221/46 |
| 5,516,001 | A * | 5/1996 | Muckenfuhs et al. | 221/63 |
| 5,699,912 | A | 12/1997 | Ishikawa et al. | |
| 5,884,804 | A * | 3/1999 | King | 221/45 |
| 6,230,929 | B1 | 5/2001 | Phelps et al. | |
| 6,331,696 | B1 | 12/2001 | Nakamura et al. | |

(Continued)

FOREIGN PATENT DOCUMENTS

DE 83 19 608 12/1984

(Continued)

OTHER PUBLICATIONS

PCT International Search Report Mailed Aug. 1, 2007, 4 Pages.

*Primary Examiner* — Gene O. Crawford
*Assistant Examiner* — Rakesh Kumar
(74) *Attorney, Agent, or Firm* — Larry L. Huston; Leonard W. Lewis; Steven W. Miller

(57) ABSTRACT

The present invention relates to a container for dispensing vertically configured wipes, which provides improved sequential dispensing of the contained wipes while permitting enhanced accessibility to the wipes within the container.

14 Claims, 6 Drawing Sheets

U.S. PATENT DOCUMENTS

| | | | | |
|---|---|---|---|---|
| 6,409,044 | B1 | 6/2002 | Brown et al. | |
| 6,422,416 | B1 | 7/2002 | Tramontina | |
| 6,550,635 | B1 | 4/2003 | King et al. | |
| 6,585,130 | B2 * | 7/2003 | Turbett et al. | 221/45 |
| 6,758,369 | B2 | 7/2004 | Morin et al. | |
| 6,779,683 | B2 | 8/2004 | Taylor et al. | |
| 6,817,484 | B2 | 11/2004 | Morin et al. | |
| 6,905,025 | B2 | 6/2005 | Morin | |
| 6,951,292 | B2 | 10/2005 | Bando et al. | |
| D544,346 | S * | 6/2007 | Karussi et al. | D9/434 |
| 2002/0079322 | A1 * | 6/2002 | Wilkes et al. | 221/34 |
| 2002/0108962 | A1 * | 8/2002 | Mangin | 221/63 |
| 2002/0139705 | A1 * | 10/2002 | Hajianpour | 206/494 |
| 2002/0170841 | A1 * | 11/2002 | Persson | 206/440 |
| 2003/0127352 | A1 * | 7/2003 | Buschkiel et al. | 206/494 |
| 2003/0136793 | A1 * | 7/2003 | Chen | 221/63 |
| 2003/0192903 | A1 * | 10/2003 | Sauer et al. | 221/48 |
| 2003/0201274 | A1 | 10/2003 | Taylor et al. | |
| 2003/0221986 | A1 | 12/2003 | Reinke et al. | |
| 2004/0124202 | A1 | 7/2004 | Mitchell et al. | |
| 2005/0205593 | A1 * | 9/2005 | Young et al. | 221/33 |
| 2005/0279756 | A1 | 12/2005 | Bitowft et al. | |
| 2006/0180596 | A1 * | 8/2006 | Young et al. | 221/63 |
| 2007/0215632 | A1 | 9/2007 | Bendor et al. | |

FOREIGN PATENT DOCUMENTS

| | | | |
|---|---|---|---|
| JP | 2002-068333 | A | 3/2002 |
| WO | WO2005/091981 | A | 10/2005 |
| WO | WO2005091981 | A | 10/2005 |

* cited by examiner

CONTAINER FOR DISPENSING WIPES

CROSS REFERENCE TO RELATED APPLICATION

This application claims the benefit of U.S. Provisional Application No. 60/782,994 filed on 16 Mar. 2006.

TECHNICAL FIELD

The present invention relates to a container for dispensing vertically configured wipes. More specifically, the invention is directed to a pop-up container which provides improved sequential dispensing of wipes.

BACKGROUND

Containers for dispensing wipes, and in particular pre-moistened wipes, are well known in the art. Wipes are typically supplied as a stack in sheet form from a generally rectangular-shaped box or dispenser. The dispenser has an opening, typically at the top, through which individual wipes are removed by the user. Wipes may also be stacked and packaged in a refill softpack.

Early wipe dispensers were of the "reach-in type". The user had to insert his or her fingers through the dispensing opening, grasp a wipe, and pull it out through the dispensing opening.

Over time, the desire for increased convenience led to sequential or pop-up dispensers. In such dispensers, a wipe usually extends through the dispensing opening to an elevation above that of the dispenser package. The user simply grasps the exposed portion of the wipe, without the necessity of inserting fingers through the dispensing opening. In order to facilitate the removal of the wipes from the dispenser, the wipes are interfolded, which means that the wipes are folded into one-another, so that they form a chain of wipes being interconnected by folded portions. In this manner, when removing the top wipe from the stack of wipes and pulling the wipe completely through the dispensing opening in the dispensing box, the pulled-out wipe will automatically bring a portion of the next wipe in the stack through the opening thereby making it readily available for gripping and removing form the dispenser.

One problem frequently encountered in the pop-up dispensing packages of the prior art is the transition from the reach-in dispensing mode in which the product is shipped to the pop-up dispensing mode which is preferred by the consumer. The dispensing opening must be large enough to allow the consumer to reach his or her fingers therethrough to grasp the wipe and begin the pop-up dispensing process. On the other hand, the dispensing opening must be small enough to constrict the wipes dispensed therethrough, so that a wipe may be separated from the succeeding wipes. Another drawback associated with the use of the wipe dispensing boxes of the prior art is that they tend to occupy substantial surface on the shelves.

Partial solutions to the above-mentioned drawbacks have been provided with for example in U.S. Pat. No. 4,534,491, which discloses a canister-type dispensing device. However, the latter does not provide satisfactory accessibility to the contained wipes and may even lead finger injury during the dispensing process. Another partial solution is described in WO-A-2005/091981, which discloses a wipe dispensing container that provides good accessibility to the contained wipes but the dispensing performance of which may still need to be improved.

It is therefore an objective of the present invention to provide a container for dispensing vertically configured wipes, which provides improved sequential dispensing of the contained wipes while permitting enhanced accessibility to the wipes within the container.

It has now been found that this objective can be met by providing a container 1 for dispensing vertically configured wipes 8, the container 1 comprising a body portion 2 and a cover member 3 attached to the body portion 2; wherein the cover member 3 defines at least a first plane 4 and a second plane 5, the cover member 3 further comprising a first aperture 6 located in the first plane 4 and a second aperture 7 located in a second plane 5, wherein the first aperture 6 and the second aperture 7 are in communication with each other, and wherein the first aperture 6 extends over the second plane 5.

Advantageously, the dispensing container 1 according to the present invention provides the user with a completely safe wipe dispensing experience, without the danger of finger injury. Also, the dispensing container 1 of the present invention allows the user with a better viewing of the content of the container 1 and permits quick determination of the number of wipes 8 remaining within the container 1.

A further advantage associated with the dispensing container 1 according to the present invention is that it provides excellent sealing vis-à-vis the contained product. The dispensing container 1 of the present invention may indeed be used for both wet and dry wipes 8.

It is still another advantage that, due its particular configuration and shape, the dispensing container 1 of the present invention is substantially thin profile, substantially flat, lightweight, easy to stack, and occupies less space per volume of wipes 8 enabling more effective storage and transport.

It is still a further benefit that the dispensing closure 1 of the present invention is easy-to-use and easily refillable.

Other advantages and more specific properties of the dispensing container 1 according to the present invention will be clear after reading the following description of the invention in combination with the attached drawings.

SUMMARY OF THE INVENTION

The present invention relates to a container 1 for dispensing vertically configured wipes 8, the container 1 comprising body portion 2 and a cover member 3 attached to the body portion 2; wherein the cover member 3 defines at least a first plane 4 and a second plane 5, the cover member 3 further comprising a first aperture 6 located in the first plane 4 and a second aperture 7 located in a second plane 5, wherein the first aperture 6 and the second aperture 7 are in communication with each other, and wherein the first aperture 6 extends partially over the second plane 5.

In another embodiment, the present invention encompasses a process of manufacturing a container 1 for dispensing vertically configured wipes 8, wherein the process comprises the steps of: (a) providing a container 1 suitable for containing and dispensing vertically configured wipes 8, wherein the container 1 comprises a body portion 2 and a cover member 3 attached to the body portion 2, and wherein the cover member 3 defines at least a first plane 4 and a second plane 5; (b) providing a first aperture 6 located in the first plane 4 and a second aperture 7 located in the second plane 5, wherein the first aperture 6 and the second aperture 7 are in communication with each other, and wherein the first aperture 6 extends over the second plane 5.

The present invention is further directed to a process of dispensing wipes 8 contained within a container 1, wherein the process comprises the steps of: (a) providing a container 1 suitable for containing and dispensing vertically configured wipes 8, wherein the container 1 comprises a body portion 2 and a cover member 3 attached to the body portion 2, and wherein the cover member 3 defines at least a first plane 4 and a second plane 5; (b) providing a first aperture 6 located in the first plane 4 and a second aperture 7 located in the second plane 5, wherein the first aperture 6 and the second aperture 7 are in communication with each other, and wherein the first aperture 6 extends over the second plane 5; (c) disposing vertically configured wipes 8 inside the container 1, each wipe 8 being releasably attached to an adjacent wipe 8; (d) partially drawing at least one first wipe 8 through the first aperture 6 by reaching there-through; (e) at least partially transferring the at least one first wipe 8 from the first aperture 6 to the second aperture 7; (f) withdrawing the at least one first wipe 8 from the container 1; (g) separating the at least one first wipe 8 from the adjacent wipe 8, whereby the adjacent wipe 8 does not fall back inside the container 1; and (h) repeating steps (f) and (g) until all the wipes 8 contained within the container 1 are depleted.

DETAILED DESCRIPTION OF THE INVENTION

Figure 1:
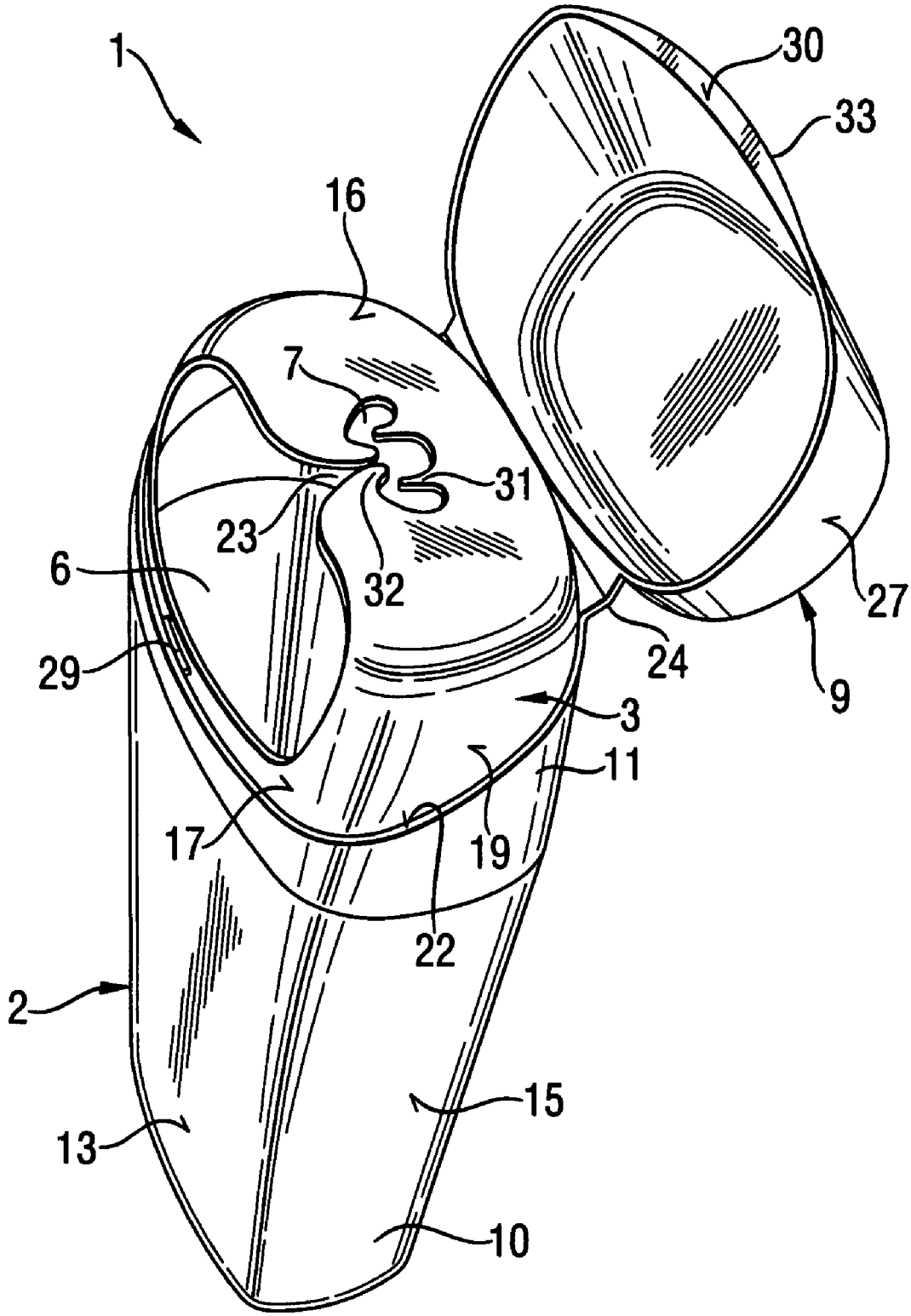
FIG. 1 is a top perspective view of a dispensing container 1 according to the invention, representing a body portion 2 with a lid 9 in an open position to expose a cover member 3 defining an exemplary combination of a first aperture 6 and a second 7 aperture.

For the purposes of promoting and understanding the principles of the present invention, reference will be made to the embodiment illustrated in the drawings and specific language will be used to describe the same. While this invention is susceptible of embodiments in many different forms, this specification and the accompanying drawings discloses specific forms as examples of the invention. However, the invention is not intended to be limited to the embodiment so described.

In a first embodiment, the present invention is directed to a container 1 for dispensing vertically configured wipes 8, the container 1 comprising a body portion 2 and a cover member 3 attached to the body portion 2; wherein the cover member 3 defines at least a first plane 4 and a second plane 5, the cover member 3 further comprising a first aperture 6 located in the first plane 4 and a second aperture 7 located in a second plane 5, wherein the first aperture 6 and the second aperture 7 are in communication with each other, and wherein the first aperture 6 extends over the second plane 5.

Referring to FIG. 1, a dispensing container 1 according to a first embodiment of the invention is represented, embodying a body portion 2 with a lid 9 in an open position to expose a cover-member 3 defining an exemplary combination of a first 6 and a second 7 aperture.

Body Portion 2

In accordance with the present invention, and as illustrated in the accompanying drawings, the dispensing container 1 comprises, as a first essential element, a body portion 2 having a generally upright and open-ended shape for receiving and holding wipes 8. Preferably, said body portion 2 comprises a lower closed end 10 for supporting said body portion 2, and an upper open end 11 delimiting a dispensing opening.

Suitable body portions 2 are well known in the art of wipe 8 packaging. Body portion 2 for use in the present invention may be relatively rigid, such as that described e.g. in U.S. Pat. No. 6,905,025 or in WO-A-2005/091981. Typically, rigid or semi-rigid body portions 2 are made from thermoformed material, molded plastic, polymeric material, metallized or laminate structures, lined paperboards or cardboard materials. Alternatively, a suitable body portion 2 for use herein may be made from flexible material such as a multilayered polymeric film.

The body portion 2 for use in the present invention being preferably rigid, the disclosure herein will be primarily directed towards rigid embodiments of the present invention, but it is not so limited. Preferably, said body portion 2 is constructed from lightweight thermoplastic material.

Rigid body portions 2 according to a preferred embodiment of the present invention may have virtually any suitable configuration, form or dimension for accommodating vertically configured wipes 8. Suitable shapes for the body portion 2 of the present invention include but are not limited to cylindrical or upright rectangular.

Figure 6:
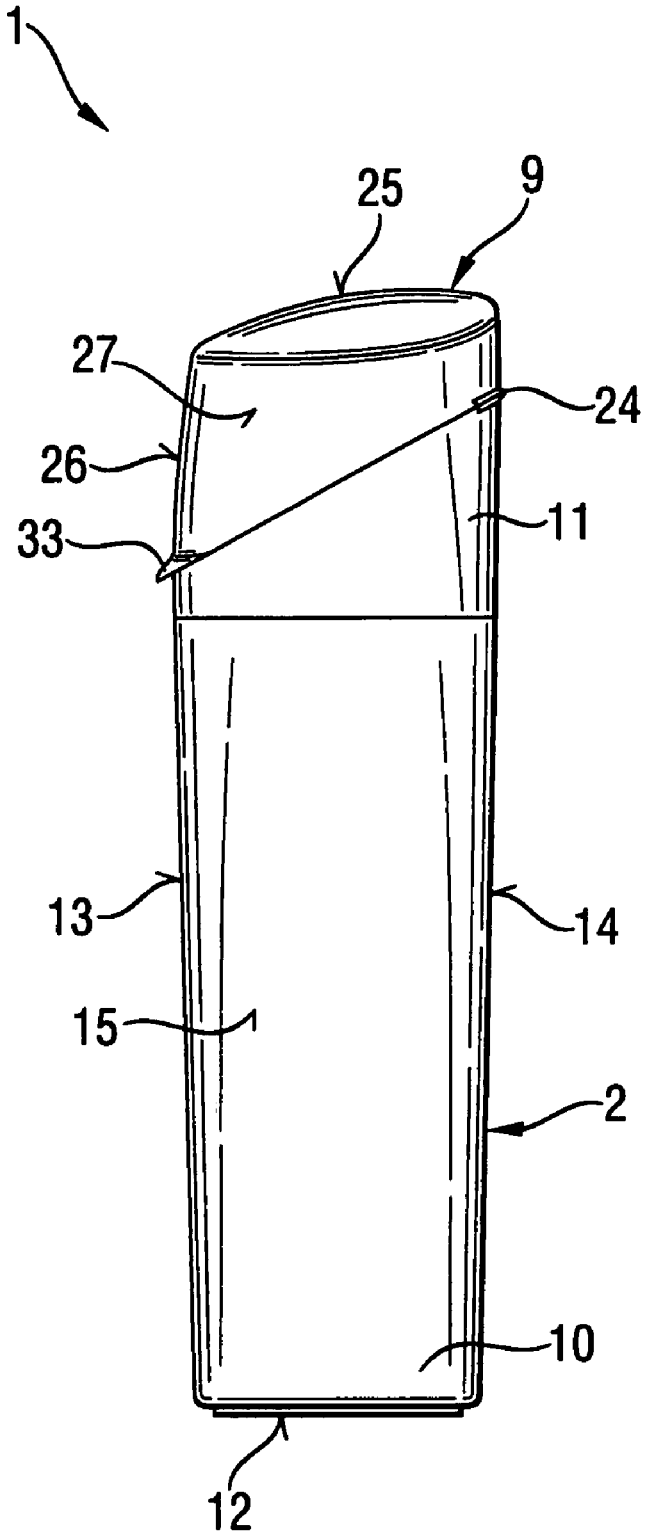
FIG. 6 is a side view of the dispensing container 1 of FIG. 5.

In a preferred execution of the present invention, the body portion 2 for use herein is substantially rectangular in shape, and defines a substantially rectangular profile (see FIG. 6). Preferred body portion 2 defines an upper open end 11 and has a bottom wall 12 joined to a front 13 and rear wall 14, and a pair of sidewalls 15. The front wall 13 may be shorter than the rear wall 14 with the upper edges of the sidewalls 15 extending angularly upwardly toward the rear wall 14. It is to be appreciated that the front wall 13 may be of substantially the same height as the rear wall 14.

The body portion 2 forms an internal space or pocket for housing the vertically configured wipes 8 contained within the dispensing container 1. The wipes 8 may be packaged in the dispensing container 1 in any convenient configuration which allows easy removal of a single or multiple wipes 8 from the dispensing container 1.

Cover Member 3

The dispensing container 1 according to the present invention further comprises a cover member 3.

Cover member 3 for use herein, may virtually have any suitable configuration, form or dimension for accommodating the upper open end 11 of the body portion 2. Suitable configuration for the cover member 3 will be readily recognized by those skilled in the art. However, cover member 3 for use in the present invention shall define at least a first plane 4 and a second plane 5. Suitable shapes for cover member 3 for use in the present invention include, but are not limited to, cylindrical box-like body or rectangular box-like body.

In a preferred embodiment of the present invention, and as represented in FIG. 1, the cover member 3 is in the form of a substantially rectangular box-like body comprising a top wall 16, a front wall 17, a back wall 18, a pair of sidewalls 19 and an open bottom defining a cavity for receiving edges of the stack of wipes 8.

Preferably, the front wall 17 defines the first plane 4 for use herein, and the top wall 16 defines the second plane 5 for use herein. According to this preferred execution, the first plane 4 preferably forms an angle of from about 10 to 170 degrees with the second plane 5. More preferably, the first plane 4 forms an angle of from about 40 to 140 degrees, even more preferably of from about 70 to about 110 degrees, most preferably of from about 85 to 95 degrees, with the second plane 5. In a highly preferred execution of the present invention, the first plane 4 forms an angle of about 90 degrees with the second plane 5.

Accordingly, in a preferred execution of the present invention, said first plane 4 and said second plane 5 are substantially orthogonal with each other.

In still another preferred embodiment, the front wall 17 preferably representing the first plane 4 is preferably substantially vertical. Accordingly, the top wall 16 representing the second plane 5 is preferably substantially horizontal. Similarly, the back wall 18 and the sidewalls 19 are preferably substantially vertical. Typically, the front wall 17 curves outwardly and downwardly from the top wall 16 to the lower edge 20 of the front wall 17. The junction between the top wall 16 and the front wall 17 preferably defines a beveled angle 21.

In one embodiment of the present invention (not represented), the cover member 3 is an integral part of the body portion 2 which permanently covers the upper open end 11 of said body portion 2. According to this execution of the present invention, the cover member 3 is totally integrated within the structure of the body portion 2 such as no delimitation exists between those two parts. A dispensing container 1 according to this embodiment will preferably include a separate loading opening (not represented), so as to permit the dispensing container 1 to be loaded with a set of vertically configured wipes 8.

According to a preferred embodiment, the cover member 3 is a separate element from the body portion 2, which is preferably removably mounted in the upper open end 11 of said body portion 2. The cover member 3 may be easily removed to permit access to the interior of the body portion 2, and therefore remove any wipe 8 not drawn through the dispensing container 1 or refill the body portion with a new set of vertically configured wipes 8.

Typically, the cover member 3 is press fit into the upper open end 11 of the body portion 2. Preferably, the cover member 3 further comprises a mounting flange 22 which surrounds the open bottom at the lower edge of the cover member 3.

Accordingly, the depth of said cover member 3 is slightly inferior to that of the body portion 2. The width of the cover member 3 is slightly inferior to that of the body portion 2. This sizing allows the lid 9, as hereinafter described, to seal in a substantially flush position with the body portion 2. The mounting flange 22 abuts the upper edges of the walls of the body portion 2 to substantially cover the open end of the body portion 2. The front wall 17 of the cover member 3 faces the front of the body portion 2 when fitted on the upper open end 11 of the body portion 2. The mounting flange 22 substantially prevents the cover member 3 from slipping into the body portion 2 and provides efficient sealing means.

First 6 and Second 7 Aperture

As above-indicated, the cover member 3 for use in the present invention, further comprises a first aperture 6 located in the first plane 4 and a second aperture 7 located in a second plane 5, wherein the first aperture 6 and the second aperture 7 are in communication with each other, and wherein the first aperture 6 extends partially over the second plane 5.

The first aperture 6 and the second aperture 7 for use herein may virtually have any suitable configuration, form or dimension for accommodating the dimension and shape of the cover member 3 as well as the characteristics of the wipe material. However, the first aperture 6 for use in the present invention shall extend partially over the second plane 5 and shall be in communication with the second aperture 7. Suitable configuration for the apertures 6 and 7 will be readily recognized by those skilled in the art.

It has been surprisingly discovered that by providing a dispensing container 1 comprising a first aperture 6 located in a first plane 4 which extends partially over a second plane 5, a number of benefits is obtained, including improved access to the wipe 8, improved reach into the container 1, improved visibility of the wipes 8 before end during the dispensing process and improved ability to remove multiple wipes 8 simultaneously, if needed. In particular, the improved access to the container 1 makes the removal of the first and the last wipe 8 much easier, particularly in the case of pre-moistened wipes 8.

Also, it has been surprisingly found that the provision of the first aperture 6 and the second aperture 7 in two distinct planes allows improved and very intuitive separation of the threading and the dispensing function.

Figure 2:
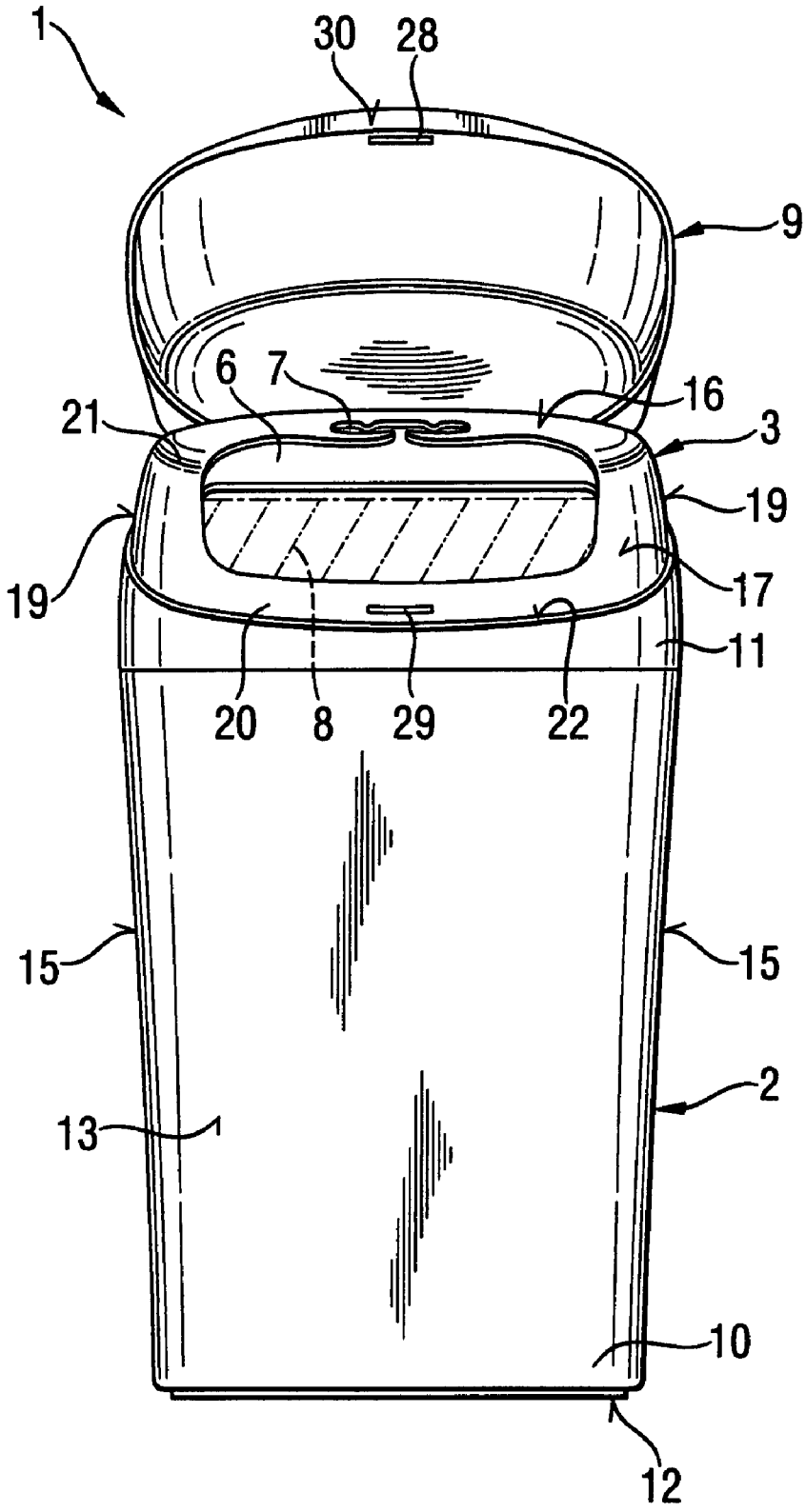
FIG. 2 is a front view of the dispensing container 1 of FIG. 1.

Preferably, the first aperture 6 and the second aperture 7 are in communication with each other via a guiding channel 23, preferably a V-shaped guiding channel, as represented in FIG. 1. According to a preferred embodiment of the invention, either of the first aperture 6 or the second aperture 7 shall be adapted so as to permit the user to insert a finger and grab onto the leading edge of a wipe 8 contained within the dispensing container 1 (hereinafter referred to as "the threading aperture"). The other aperture (hereinafter referred to as "the dispensing aperture") is preferably narrower, in size, than the threading aperture (see FIG. 3). As shown in FIG. 2, the threading aperture may be provided with a substantially oblong shape.

According to a very preferred execution of the present invention, wherein the front wall 17 represents the first plane 4 and the top wall 16 represents the second plane 5, the first aperture 6 which is preferably the threading aperture, is located in the front wall 17 and partially extends over the top wall 16. As for the second aperture 7, which is accordingly the dispensing aperture, it is located in the top wall 16.

In a highly preferred embodiment, the first aperture 6 has a curved substantially rectangular shape and extends over substantially the entire surface of the front wall 17. The second aperture 7 is preferably provided with a substantially ovoid shape comprising protrusions. More preferably, said second aperture 7 comprises two protrusions 31 which are integrally part of the top wall 16, as well as two additional protrusions 32 formed from said guiding channel 23 reaching into said second aperture 7. According to a highly preferred execution, the protrusions 31 and 32 comprised in said second aperture 7 are offset.

While preferred shapes and sizes of the apertures 6 and 7 are represented in the accompanying drawings, other configurations may be used within the confines of the invention.

In a preferred execution, the edges of the first aperture 6 and second aperture 7 are provided with a soft material so that neither the wipe 8 nor the user's finger may be caught or damaged when drawing the wipe 8 from the dispensing container 1.

Lid 9

The body portion 2 for use herein may optionally, but preferably, comprise a lid 9 intended to cover the cover-member 3 and the contained apertures 6 and 7.

A lid 9 for use herein may virtually have any suitable configuration, form or dimension for accommodating the dimension and shape of the cover member 3 as well as the characteristics of the contained wipes 8. Suitable lid 9 for use herein will easily be recognized by those skilled in the art of packaging.

Figure 4:
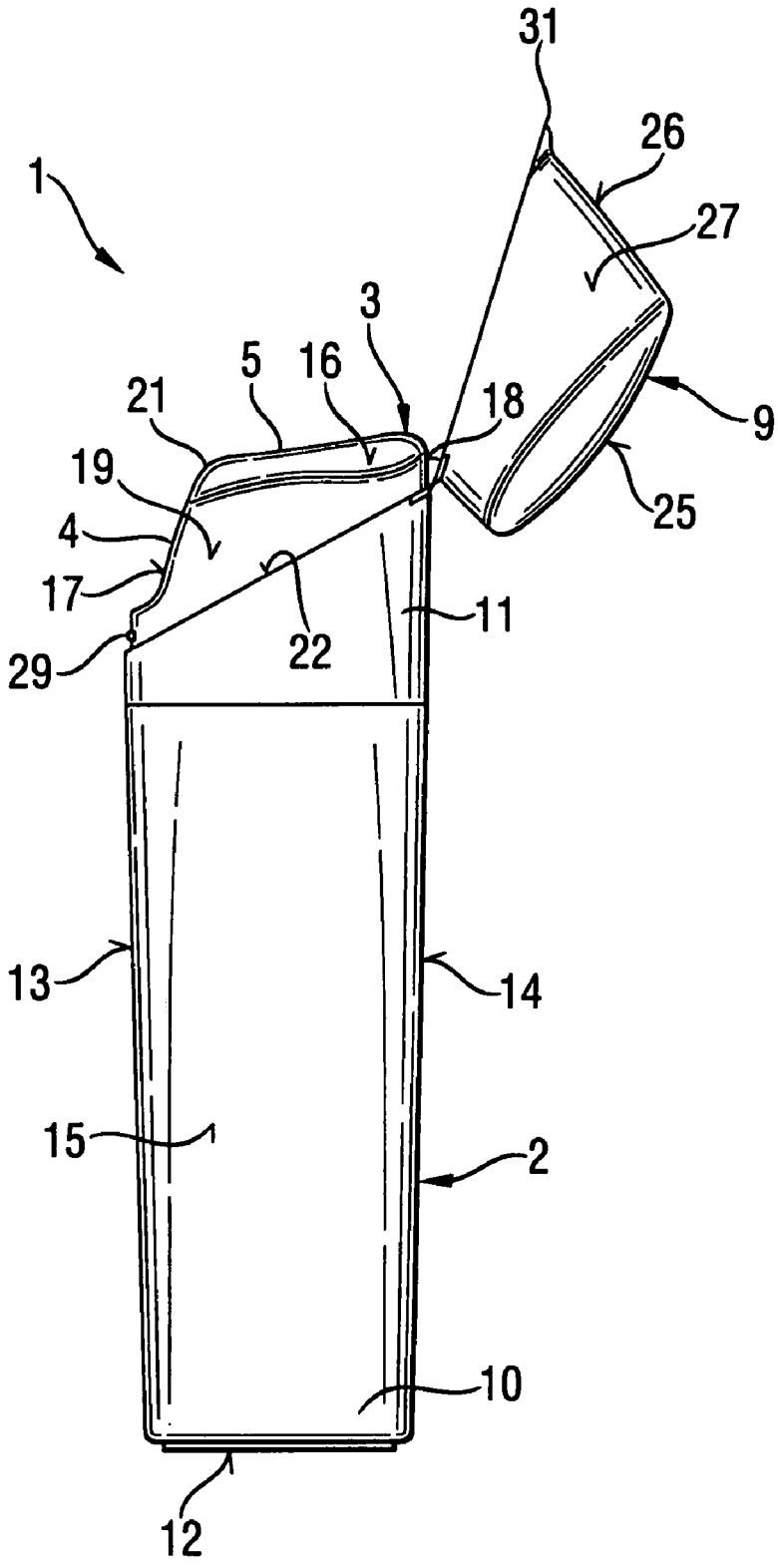
FIG. 4 is a side view of the dispensing container 1 of FIG. 1.

Preferably, the lid 9 for use in the present invention is capable of providing air-tight sealing with respect to the content of the dispensing container 1. In a more preferred execution and as represented in FIG. 1 and FIG. 4, the lid 9 is a hinged lid capable of pivoting around a suitable articulation means 24. According to this preferred embodiment, the lid 9 may be pivoted open to provide access to the wipes 8 and pivoted closed to be substantially flush with the body portion 2. According a preferred embodiment, the lid 9 for use herein has a lid top wall 25 joined to a lid front wall 26, and a pair of substantially triangular lid sidewalls 27. The free edges of the lid sidewalls 27 may extend angularly downwardly toward the front wall 26 of the lid 9 when it the closed position as shown in FIG. 6. The lid 9 is typically constructed from the same material as the body portion 2, preferably of lightweight molded thermoplastic. The body portion 2 and the lid 9 may be manufactured from a single mold therefore lowering production costs.

Figure 5:
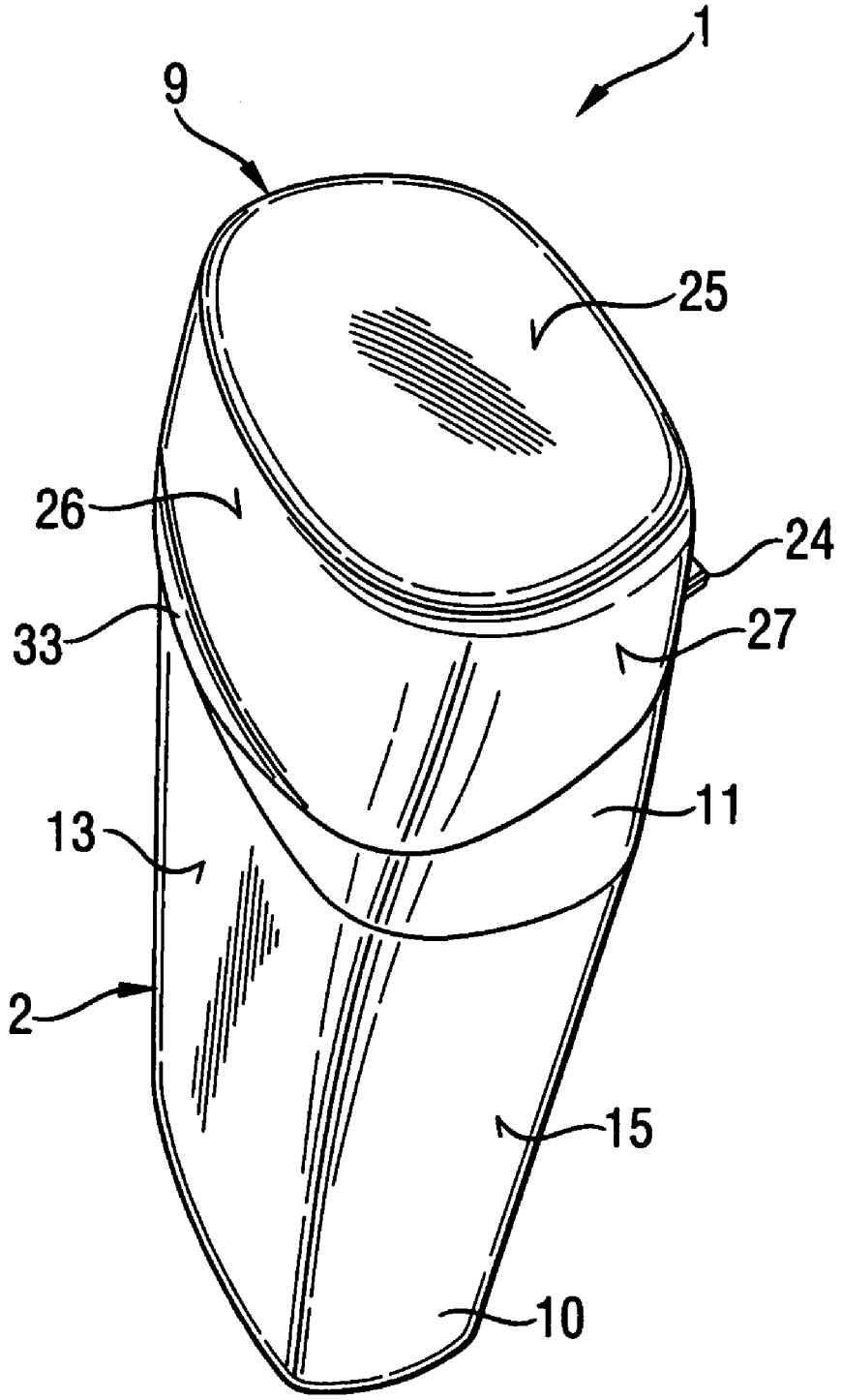
FIG. 5 is a top perspective view of a dispensing container 1 according to the invention, with a lid 9 in a closed position.

The lid 9 may be mounted onto the upper edge of the rear wall 14 of the body portion 2. The lid 9 is preferably attached to the upper edge of the rear wall 14 of the body portion 2 via a suitable articulation means 24, which is preferably a hinge or any hinge-type assembly commonly known in the art. The lid 9 opens from the front of the dispensing container 1 as shown in FIG. 1 and FIG. 2. When deployed in the open position, the cover member 3 seated in the upper open end 11 of the body portion 2 is exposed. The lid 9 may preferably include and internal bead 28, or any fastening means commonly known in the art, preferably located at a lower edge 30 thereof for snap fit connection with a corresponding bead 29 in an upper portion of the body portion 2, in order to securely close the lid 9. In this regard, the lid 9 includes a lower edge 30 retained in mating and sealing relation to the top of the body portion 2 to keep the wipes 8 from drying out, when pre-moistened wipes 8 are contained within the dispensing container 1. When the lid 9 is closed, as shown in FIG. 5 and FIG. 6, the dispensing container 1 appears as a substantially seamless container and has preferably a substantially thin profile. As such, the dispensing container 1 may easily be stored and transported where space is at premium.

According to a preferred aspect of the invention, the lid 9 is further provided with a gripping means 33, which is preferably a finger grip and which is typically located at the lower edge 30 of the lid 9. Any gripping means commonly known in the art may be used in the context of the present invention. In a very preferred embodiment, the gripping means 33 is especially adapted to provide suitable gripping by pinching with two fingers.

The exterior configuration of the lid 9 for use herein may be varied as desired for aesthetic appearance. The latter may be e.g. provided with incrustations, serrations, grooves, indentations or any other operation commonly know in the art.

Spring Element

As another optional, but preferred feature, the body portion 2 for use herein may further include a spring element (not represented), preferably in the form of a leaf spring. The leaf spring is intended to press the wipes 8 toward one wall of the body portion 2 and toward the upper end of the body portion 2. The leaf spring substantially retains the vertically configured wipes 8 in an upright fixed position to help dispense preferably one wipe 8 at a time.

Wipe 8

As used herein, the term wipe 8 refers to e.g. cleaning wipe, baby wipe, facial wipe, cosmetic and/or hygiene wipe, and the like. The intended use, however, does not limit the final product. By way of a non-limiting example, a preferred wipe 8 for dispensing from the container 1 of the present invention is a surface cleaning wipe, preferably a hard surface cleaning wipe.

In a preferred execution of the present invention, the wipes 8 are pre-moistened wipes 8, sometimes referred to as wet wipes 8, or towelettes. In that specific preferred embodiment of the present invention, pre-moistened wipes 8 are impregnated with an appropriate cleansing or cleaning lotion. In a highly preferred embodiment, the pre-moistened wipes 8 for use in the present invention, are impregnated with a hard-surface cleaning lotion.

Suitable lotions for use in the context of the present invention as well as optional ingredients which may be incorporated in said lotion are described for example in WO 03/031557 under the paragraph entitled "Aqueous Composition" from page 12 to page 36.

As above-indicated, the body portion 2 for use herein forms an internal space or pocket for housing the vertically configured wipes 8 contained within the dispensing container 1. The wipes 8 may be packaged in the dispensing container 1 in any convenient configuration which allows easy removal of a single or multiple wipes 8 from the dispensing container 1. Preferably, the wipes 8 are packaged in rolls, stacks, piles or are interleafed. According to any of these configurations, each wipe 8 is releasably attached to an adjacent wipe 8.

More preferably, the wipes 8 are provided in a stacked configuration which may comprise any number of wipes 8. Typically, the stack comprises from 2 to 150, more preferably from 5 to 100, most preferably from 10 to 60 wipes. Moreover, the wipes 8 may be provided folded or unfolded. Most preferably, the wipes 8 are stacked in a folded configuration.

Figure 3:
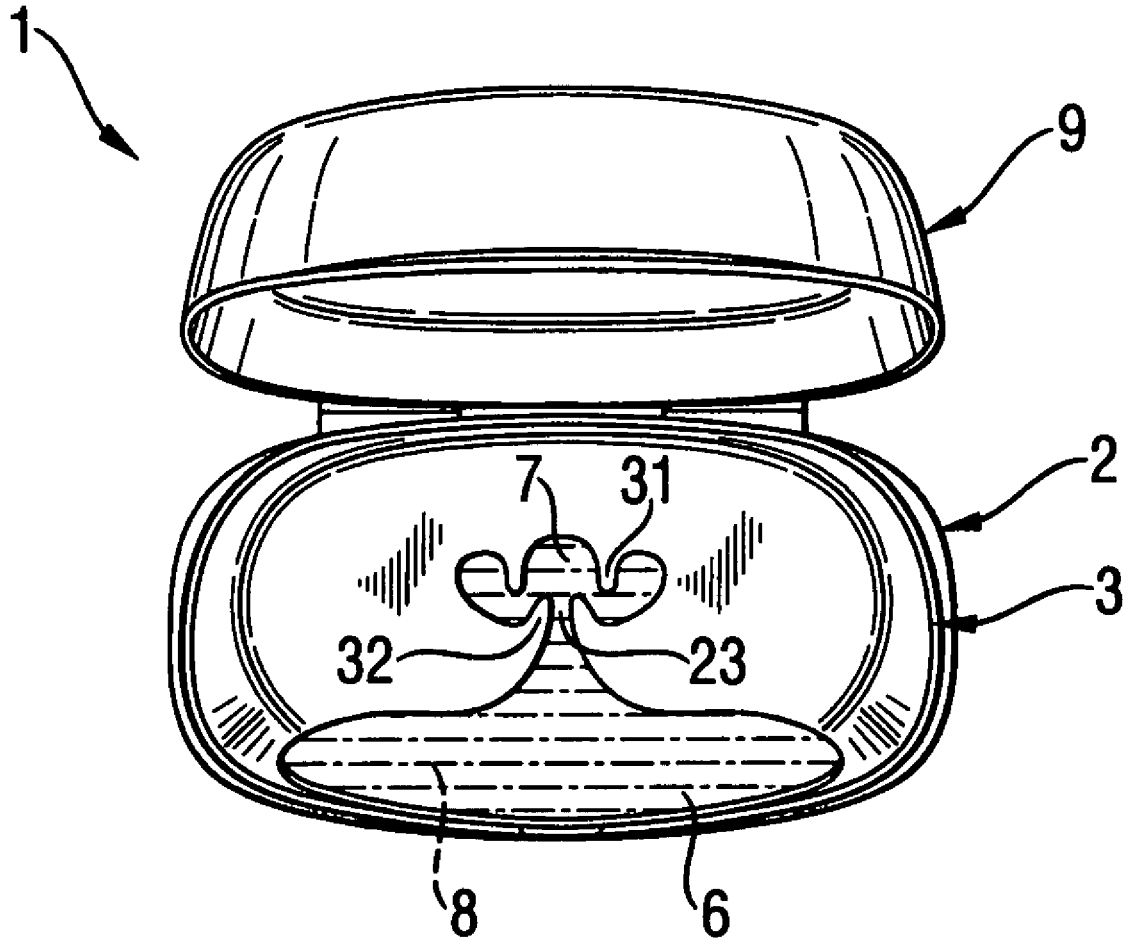
FIG. 3 is a top view of the dispensing container 1 of FIG. 1.

The stack of non-leafed or interleafed wipes 8 may be placed directly into the body portion 2. The longitudinal axis of the stack runs parallel to longitudinal axis of the body portion 2. As shown in FIG. 3, the wipes 8 can generally be described as having two opposing planar faces and edges surrounding the perimeter of the faces. The stack of wipes 8 is loaded vertically into the body portion 2, so that the wipes 8 are loaded on their edge with the planar faces of the wipes 8 facing the front and back walls of the body portion 2. The stack of wipes 8 may be oriented in a direction such that the planar surface and a leading edge of the wipes 8 faces the front of the body portion 2 (see FIG. 3). When fully loaded with wipes 8, the pressure on the wipes 8 will force the uppermost edge of the wipes 8 at the front of the container 1 to fan or pivot forward, presenting the leading edge of the wipe 8 that can be easily reached by the user through the threading opening, which is preferably first aperture 6. The user can then channel the wipe 8 through the guiding channel 23 into the dispensing aperture, which is preferably the second aperture 7, to be withdrawn by the user from the dispensing container 1. This also permits the user to remove the individual wipe 8 from the edge of the stack by grasping an edge of a wipe 8 rather than grasping the middle of the planar surface of the wipe 8. Once an interfolded wipe 8 is dispensed, a second interfolded wipe 8 pops up through the dispensing aperture. In contrast to prior art dispensing container 1 and methods, the wipe 8 is peeled or slid away from the rest of the stack of wipes 8, rather than unleaving the wipe 8 as in other containers and methods. The front wipe 8 is pulled at the leading edge of the wipe 8 in a direction parallel to the direction of the wipe 8. This makes it easier to dispense one wipe 8 at a time. Depending on the fold pattern of the wipes 8, the cover member 3 permits a single wipe 8 at a time to dispense with the next wipe's tail trailing or the cover member 3 may be rethreaded for each use.

In use, and according to a highly preferred execution of the present invention, the lid 9 may be flipped open by the user to expose the wipe 8 drawn through the dispensing aperture in the cover member 3. If the wipe 8 is not exposed, the user may either grasp one of the wipes 8 through one of the threading opening of the cover member 3, or temporarily remove the cover member 3 to gain access to the interior of the dispensing container 1. Similarly, when the dispensing container 1 is empty, it may be refilled by removing the cover member 3, inserting the refill stack of vertically configured wipes 8, and replacing the cover member 3 followed by drawing of the wipe 8 through the dispensing aperture, respectively.

According to an alternative execution of the invention, wherein the cover member 3 is integrally part of the body portion 2, the dispensing container 1 will preferably include a separate loading opening (not represented), preferably a bottom loading opening so as to permit the dispensing container 1 to be refilled with a new set of vertically configured wipes 8.

Once the wipe 8 has been removed, the lid 9 may be securely snapped closed to conveniently store or transport the wipe 8 dispensing container 1 until next use. The wipe 8 may be dispensed whether the container 1 is positioned horizontally or vertically on a surface or within a drawer.

A Process of Manufacturing a Container 1 for Dispensing Vertically Configured Wipes 8.

In another embodiment, the present invention encompasses a process of manufacturing a container 1 for dispensing vertically configured wipes 8, wherein the process comprises the steps of:

(a) providing a container 1 suitable for containing and dispensing vertically configured wipes 8, wherein the container 1 comprises a body portion 2 and a cover member 3 attached to the body portion 2, and wherein the cover member 3 defines at least a first plane 4 and a second plane 5;

(b) providing a first aperture 6 located in the first plane 4 and a second aperture 7 located in the second plane 5, wherein the first aperture 6 and the second aperture 7 are in communication with each other, and wherein the first aperture 6 partially extends over the second plane 5.

A method of dispensing wipes 8 contained within a container 1

The present invention is further directed to a process of dispensing wipes 8 contained within a container 1, wherein the process comprises the steps of:

(a) providing a container 1 suitable for containing and dispensing vertically configured wipes 8, wherein the container 1 comprises a body portion 2 and a cover member 3 attached to the body portion 2, and wherein the cover member defines at least a first plane 4 and a second plane 5;

(b) providing a first aperture 6 located in the first plane 4 and a second aperture 7 located in the second plane 5, wherein the first aperture 6 and the second aperture 7 are in communication with each other, and wherein the first aperture 6 partially extends over the second plane 5;

(c) disposing vertically configured wipes 8 inside the container 1, each wipe 8 being releasably attached to an adjacent wipe 8;

(d) partially drawing at least one first wipe 8 through the first aperture 6 by reaching there-through;

(e) at least partially transferring the at least one first wipe 8 from the first aperture 6 to the second aperture 7;

(f) withdrawing the at least one first wipe 8 from the container 1;

(g) separating the at least one first wipe 8 from the adjacent wipe 8, whereby the adjacent wipe 8 does not fall back inside the container 1; and (h) repeating steps (f) and (g) until all the wipes 8 contained within the container 1 are depleted.

Although a particular embodiment of the invention has been described in detail for purposes of illustration, various modifications may be made without departing from the spirit and scope of the invention. Accordingly, the invention is not to be limited, except as by the appended claims.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container for dispensing vertically configured wipes, said container comprising a body portion and a cover member attached to said body portion; wherein said cover member defines at least a first plane and a second plane, said cover member further comprising a first aperture having a first aperture width located in said first plane and a second aperture comprising a substantially ovoid shape with opposing protrusions and having a second aperture width less than said first aperture width and being located in said second plane, wherein said first aperture and said second aperture are in communication with each other and separated by a channel having a channel width, said channel width being less than said first aperture width and said second aperture width, said channel converging in width from said first aperture to said second aperture, and wherein said first aperture partially extends over said second plane, wherein said cover member is in the form of a substantially rectangular box-like body comprising a top wall, a front wall, a back wall, a pair of sidewalls and an open bottom defining a cavity for receiving edges of the stack of wipes and wherein said front wall of said cover member corresponds to said first plane, and said top wall of said cover member corresponds to said second plane and said first aperture is disposed in the front of said container, said second aperture is disposed on the top of said container, and said channel converges in width from said first aperture to said second aperture.

2. A container according to claim 1, wherein said first plane and said second plane form an angle of from about 70 to about 110 degrees.

3. A container according to claim 1, wherein said first plane and said second plane form an angle of from about 85 to about 95 degrees.

4. A container according to claim 1, wherein said first plane and said second plane are substantially orthogonal with each other.

5. A container according to claim 1, wherein said body portion has a substantially rectangular shape.

6. A container according to claim 1, wherein said cover member is removably mounted in said body portion.

7. A container according to claim 1, wherein said first aperture has a curved substantially rectangular shape extending over substantially the entire surface of said front wall, and said second aperture is provided with a substantially ovoid shape.

8. A container according to claim 1, wherein said body portion further comprises a hinged lid intended to sealingly cover said cover member.

9. A container according to claim 8, wherein said lid is provided with a fastening means.

10. A container according to claim 1, wherein said body portion further comprises a spring element.

11. A container according to claim 1, wherein said wipes are interleafed.

12. A container according to claim 1, wherein said wipes are pre-moistened with a cleaning lotion.

13. A container according to claim 1, wherein said container is a rigid container.

14. A process of manufacturing a container for dispensing vertically configured wipes, wherein said process comprises the steps of:

(a) providing a container suitable for containing and dispensing vertically configured wipes, wherein said container comprises a body portion and a cover member attached to said body portion, and wherein said cover member defines at least a first plane and a second plane;

(b) providing a first aperture having a first aperture width located in said first plane and a second aperture comprising a substantially ovoid shape with opposing protrusions and having a second aperture width located in said second plane, wherein said first aperture and said second aperture are in communication with each other, and separated by a channel having a channel width, said channel converging in width from said first aperture to said second aperture, said channel width being less than said first aperture width and said second aperture width, said second aperture width being less than said first aperture width and wherein said first aperture partially extends over said second plane, wherein said cover member is in the form of a substantially rectangular box-like body comprising a top wall, a front wall, a back wall, a pair of sidewalls and an open bottom defining a cavity for receiving edges of the stack of wipes and wherein said front wall of said cover member corresponds to said first plane, and said top wall of said cover member corresponds to said second plane and said first aperture is disposed in the front of said container, said second aperture is disposed on the top of said container, and said channel converges in width from said first aperture to said second aperture.

* * * * *

UNITED STATES PATENT AND TRADEMARK OFFICE

CERTIFICATE OF CORRECTION

PATENT NO. : 7,922,036 B2
APPLICATION NO. : 11/712660
DATED : April 12, 2011
INVENTOR(S) : Yarron Bendor et al.

It is certified that error appears in the above-identified patent and that said Letters Patent is hereby corrected as shown below:

Title Page,

Item (75) Inventors:

Line 2, delete "Scootsdale" and insert -- Scottsdale --.

Signed and Sealed this
Fourteenth Day of February, 2012

David J. Kappos

David J. Kappos
*Director of the United States Patent and Trademark Office*